US006145253A

United States Patent [19]

Gallant et al.

[11] Patent Number: 6,145,253

[45] **Date of Patent: *Nov. 14, 2000**

[54] HEAD WALL FOR A HOSPITAL ROOM

[75] Inventors: Dennis J. Gallant, Harrison, Ohio; Edward W. Catton, New Palestine; Steven R. Westerfeld, Batesville, both of Ind.

[73] Assignee: Hill-Rom, Inc., Indianapolis, Ind.

[ * ] Notice: This patent is subject to a terminal disclaimer.

[21] Appl. No.: 09/349,658

[22] Filed: Jul. 8, 1999

Related U.S. Application Data

[60] Provisional application No. 60/091,989, Jul. 8, 1998.

[51] Int. Cl.[7] ..... A47F 10/00

[52] U.S. Cl. ..... 52/36.1; 52/220.1; 52/220.5; 52/220.7; 52/36.4; 52/27; 52/28

[58] Field of Search ..... 52/282.4, 656.9, 52/657, 712, 715

[56] References Cited

U.S. PATENT DOCUMENTS

| | | | |
|---|---|---|---|
| D. 226,353 | 2/1973 | Schultz et al. . | |
| 3,462,892 | 8/1969 | Meyer . | |
| 3,548,122 | 12/1970 | Hay . | |
| 3,567,842 | 3/1971 | Meyer . | |
| 3,660,591 | 5/1972 | Schultz et al. . | |
| 3,769,502 | 10/1973 | Schultz et al. . | |
| 4,338,485 | 7/1982 | Fullenkamp et al. . | |
| 4,589,557 | 5/1986 | Bollmann . | |
| 4,646,211 | 2/1987 | Gallant et al. . | |
| 4,781,255 | 11/1988 | Lock | 174/97 |
| 4,821,470 | 4/1989 | Kappers | 52/36 |
| 4,905,433 | 3/1990 | Miller | 52/221 |
| 4,988,062 | 1/1991 | London | 248/68.1 |
| 5,060,425 | 10/1991 | Kappers | 52/36 |
| 5,090,645 | 2/1992 | Zuercher | 248/68.1 |
| 5,115,542 | 5/1992 | Gehres | 24/543 |
| 5,209,441 | 5/1993 | Satoh | 248/74.2 |
| 5,277,005 | 1/1994 | Hellwig et al. . | |
| 5,323,565 | 6/1994 | Kappers | 52/36.4 |
| 5,389,082 | 2/1995 | Baugues | 604/174 |
| 5,399,812 | 3/1995 | Woszczyna | 174/97 |
| 5,626,172 | 5/1997 | Schumacher | 141/236 |
| 5,756,933 | 5/1998 | Pitchford et al. . | |
| 5,765,786 | 6/1998 | Gretz | 248/68.1 |
| 5,890,326 | 4/1999 | Gallant | 52/36.1 |

FOREIGN PATENT DOCUMENTS 0 683 553 A1 11/1995 European Pat. Off. .

OTHER PUBLICATIONS

Hill–Rom, Inc., The Horizon™ Headwall System From Hill–Rom®, 16 pages, 1994.

*Primary Examiner*—Carl D. Friedman
*Assistant Examiner*—Kevin McDermott
*Attorney, Agent, or Firm*—Barnes & Thornburg

[57] ABSTRACT

A head wall apparatus includes a support configured to be coupled to a wall. A front panel is coupled to the support to define an interior region of the head wall. A plurality of first gas blocks are coupled to the support, and a plurality of second gas blocks are also coupled to the support spaced apart from the first gas blocks. Each of the first and second gas blocks have an inlet and an outlet. The apparatus further includes a plurality of first and second gas supply hoses located in the interior region which are coupled to the first and second gas supply blocks, respectively. At least one divider is coupled to the support within the interior region. The at least one divider is configured to separate the first and second gas supply hoses into first and second separate pathways within the interior region.

19 Claims, 7 Drawing Sheets

HEAD WALL FOR A HOSPITAL ROOM

BACKGROUND AND SUMMARY OF THE INVENTION

This application claims the benefit of U.S. provisional application Ser. No. 60/091,989 filed Jul. 8, 1998.

The present invention relates to a head wall apparatus for a hospital room. Conventional head wall designs for hospital rooms include electrical outlets and fixed or movable gas outlets for supplying air, oxygen, a vacuum, or other gases to the hospital room. In conventional head wall designs, movable gas outlets slide on a track formed on the head wall. Gas hoses are coupled to the gas outlets. The hoses are concealed behind a front panel of the head wall. See, for example, U.S. Pat. Nos. 5,890,326 and 4,646,211.

The head wall apparatus of the present invention includes an improved gas hose management system for organizing a plurality of gas hoses within the head wall. The present invention facilitates shipment and installation of the head wall. The hose management system organizes and aligns the gas hoses to facilitate connection to a manifold block during installation of the head wall on a wall.

A head wall apparatus of the present invention includes a support configured to be coupled to a wall, and a front panel coupled to the support to define an interior region of the head wall. The apparatus also includes a plurality of first gas blocks coupled to the support, and a plurality of second gas blocks coupled to the support spaced apart from the first gas blocks. Each of the first and second gas blocks have an inlet and an outlet. The apparatus further includes a plurality of first and second gas supply hoses located in the interior region which are coupled to the first and second gas supply blocks, respectively. At least one divider is coupled to the support within the interior region. The at least one divider is configured to separate the first and second gas supply hoses into first and second separate pathways within the interior region.

The illustrated embodiment of the head wall apparatus provides first and second spaced apart brackets for separating upper and lower groups of hoses into separate pathways. The brackets guide movement of the hoses within the pathways. Illustratively, gas hoses configured to supply gas blocks on a top portion of the head wall are located in a first pathway and gas hoses configured to supply gas to gas blocks on a bottom portion of the head wall are located in a second, spaced apart pathway. Therefore, the hose management system organizes and manages movement of the hoses within the head wall to reduce the likelihood of binding of the hoses.

Additional features and advantages of the invention will become apparent to those skilled in the art upon consideration of the following detailed description of the illustrated embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF DRAWINGS

Figure 1:
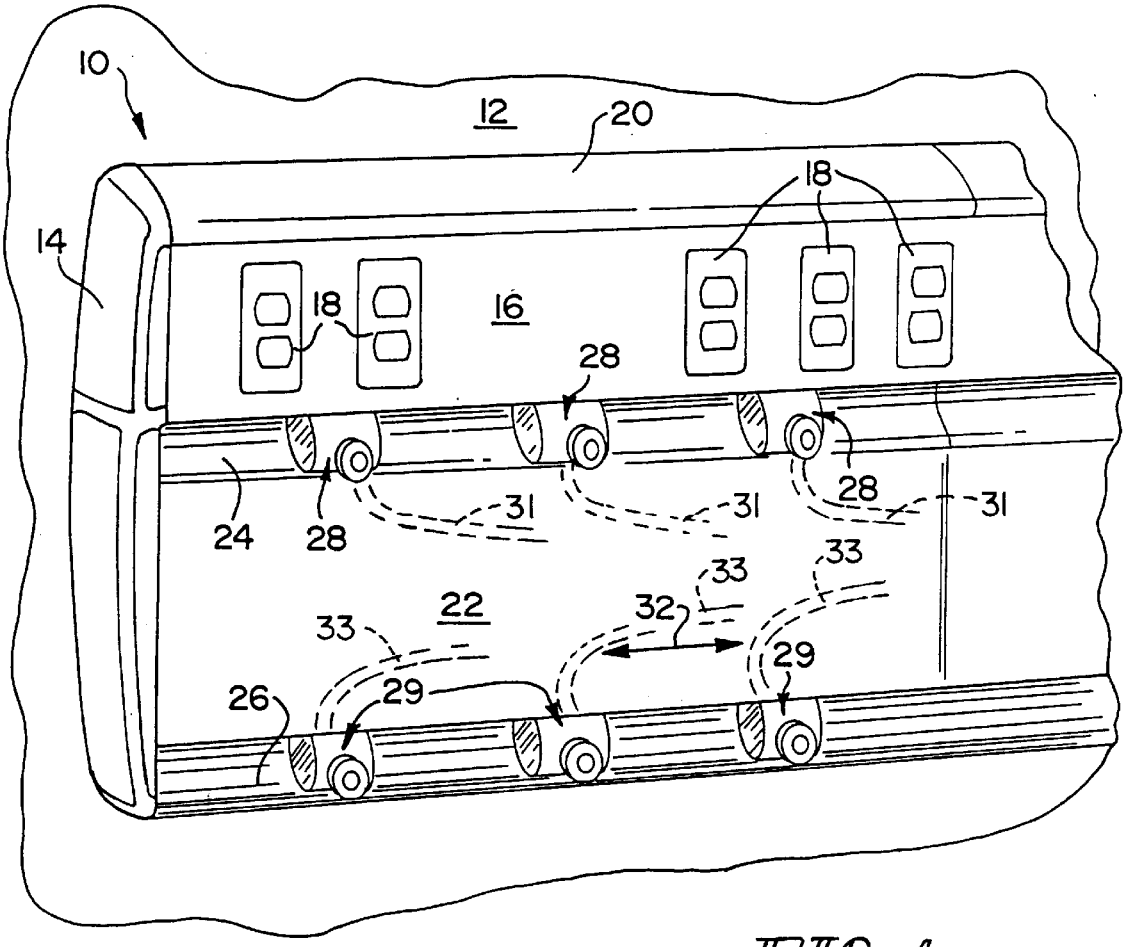
FIG. 1 is a perspective view of a head wall apparatus of the present invention which includes top and bottom shields defining upper and lower tracks for receiving movable, adjustable gas outlet blocks.

Referring now to the drawings, FIG. 1 illustrates a head wall 10 configured to be mounted on a wall 12 of a hospital room. The head wall 10 includes an end cap 14, an upper raceway cover 16 having a plurality of electrical outlets 18 coupled to electrical wires of the hospital room in a conventional manner. A pivotable concealment cover 20 is located along a top end of head wall 10 as disclosed in U.S. Pat. No. 5,890,326 which is incorporated herein by reference.

Head wall 10 further includes a front concealment cover or panel 22 and upper and lower shields or tracks 24 and 26, respectively. The tracks 24 and 26 are elongated shields which extend along the length of the head wall 10. Tracks 24 and 26 each support movable, adjustable upper and lower gas blocks 28 and 29, respectively. Gas blocks 28 and 29 move back and forth on tracks 24, 26 as illustrated by double headed arrow 32. Tracks 24 and 26 illustratively prevent dust or fluids, or other items such as trash from entering an interior region of head wall 10. It is understood that other types of tracks may be used to support the gas blocks 28 and 29, if desired.

Upper gas blocks 28 are connected to an upper set of gas supply hoses 31. Lower gas blocks 29 are coupled to a lower set of gas supply hoses 33. Hoses 31 and 33 are also connected to a manifold block 40 as discussed below to supply gases to the gas outlet blocks 28 and 29.

Figure 2:
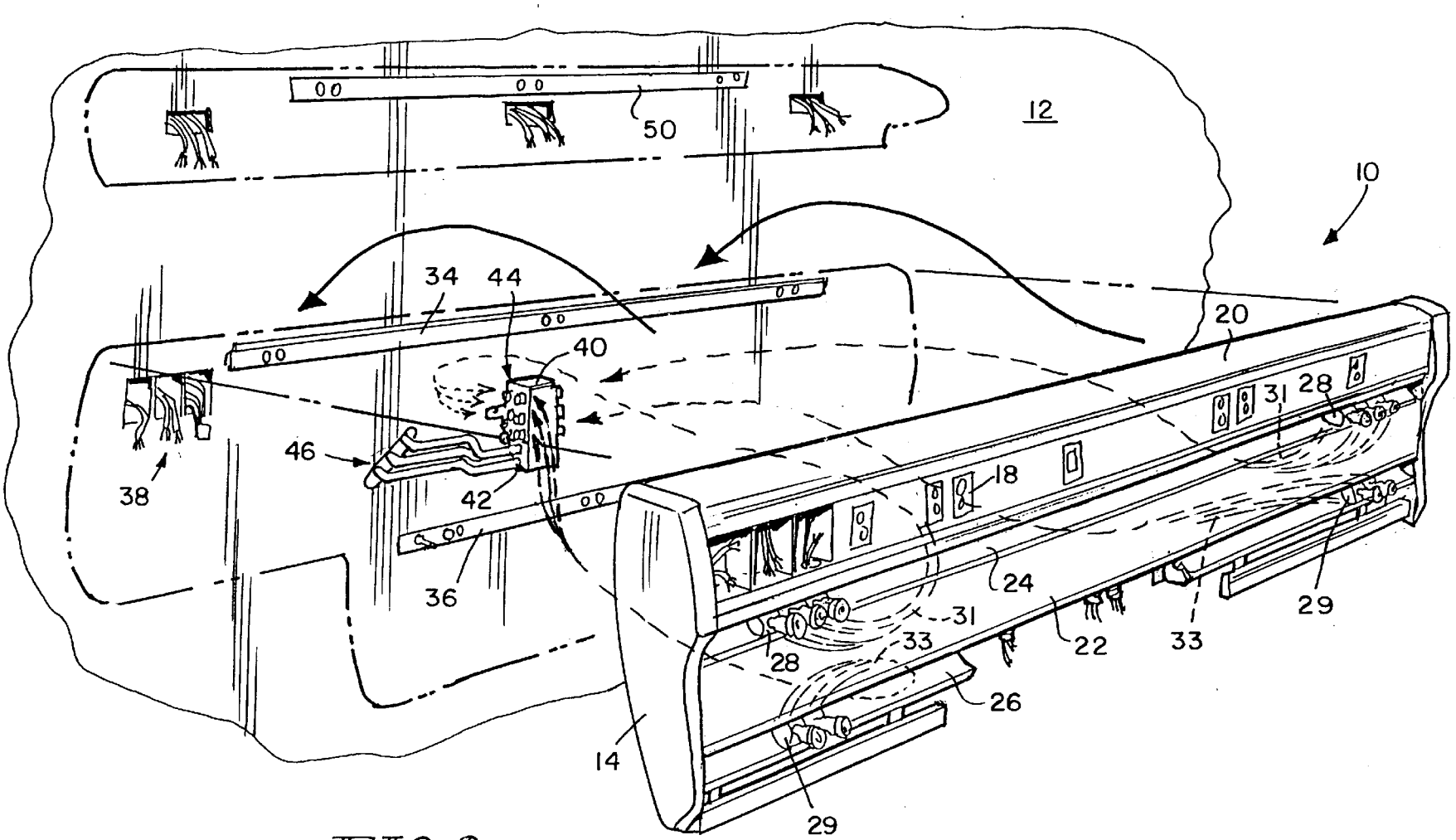
FIG. 2 is a perspective view illustrating preparation of a wall of a hospital room for installation of the head wall apparatus, installation of a gas manifold block on the wall, and the head wall prepared for hanging on the prepared wall.

Head wall 10 is designed to be mounted on a wall 12. Typically, the head wall 10 is shipped partially assembled to the hospital for installation. Since the head wall 10 includes a plurality of gas hoses 31, 33, installation is sometimes difficult when the hoses become tangled. FIG. 2 illustrates preparation of the wall 12 for receiving a head wall 10. Hanger strips 34 and 36 are first mounted on wall 12. In addition, electrical connections, data connections, or any other connections 38 are provided. A manifold block 40 including gas inlets 42 and gas outlets 44 is coupled to wall 12. Gas supply lines 46 extend through wall 12 and are coupled to manifold inlets 42 to supply gases from a gas source (not shown) to the manifold block 40. Illustratively, supply lines 46 are made from copper tubing or other suitable material. A hanger bracket 50 for a light assembly (not shown) may be mounted over the head wall mounting bracket 34, if desired.

Head wall 10 is mounted onto the hanger strip 34 and anchored to wall 12. Head wall 10 is then connected to wiring 38 to supply electricity to outlets 18.

Figure 3:
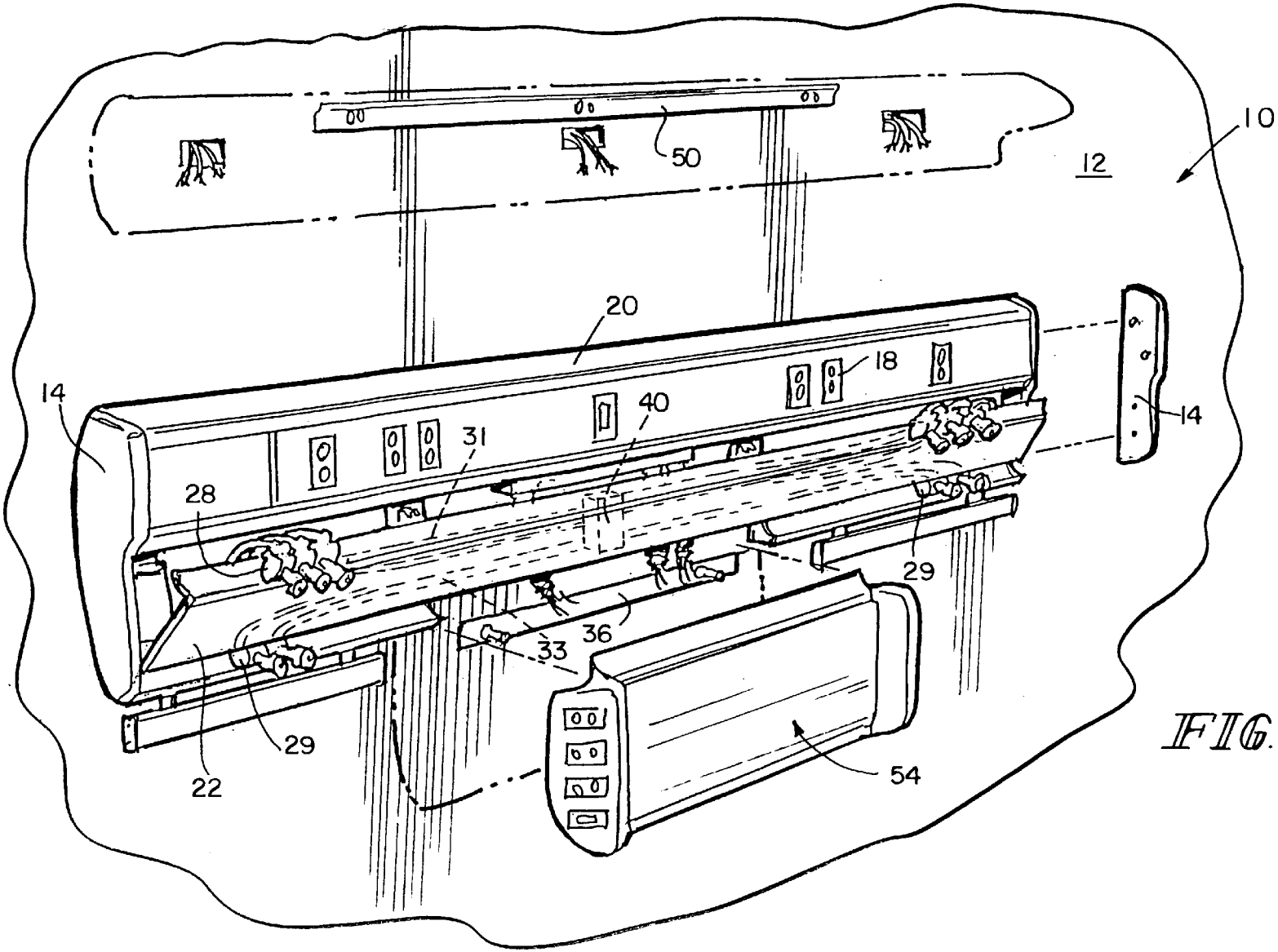
FIG. 3 illustrates installation of a bed locator on the wall and installation of end caps on opposite ends of the head wall.
Figure 4:
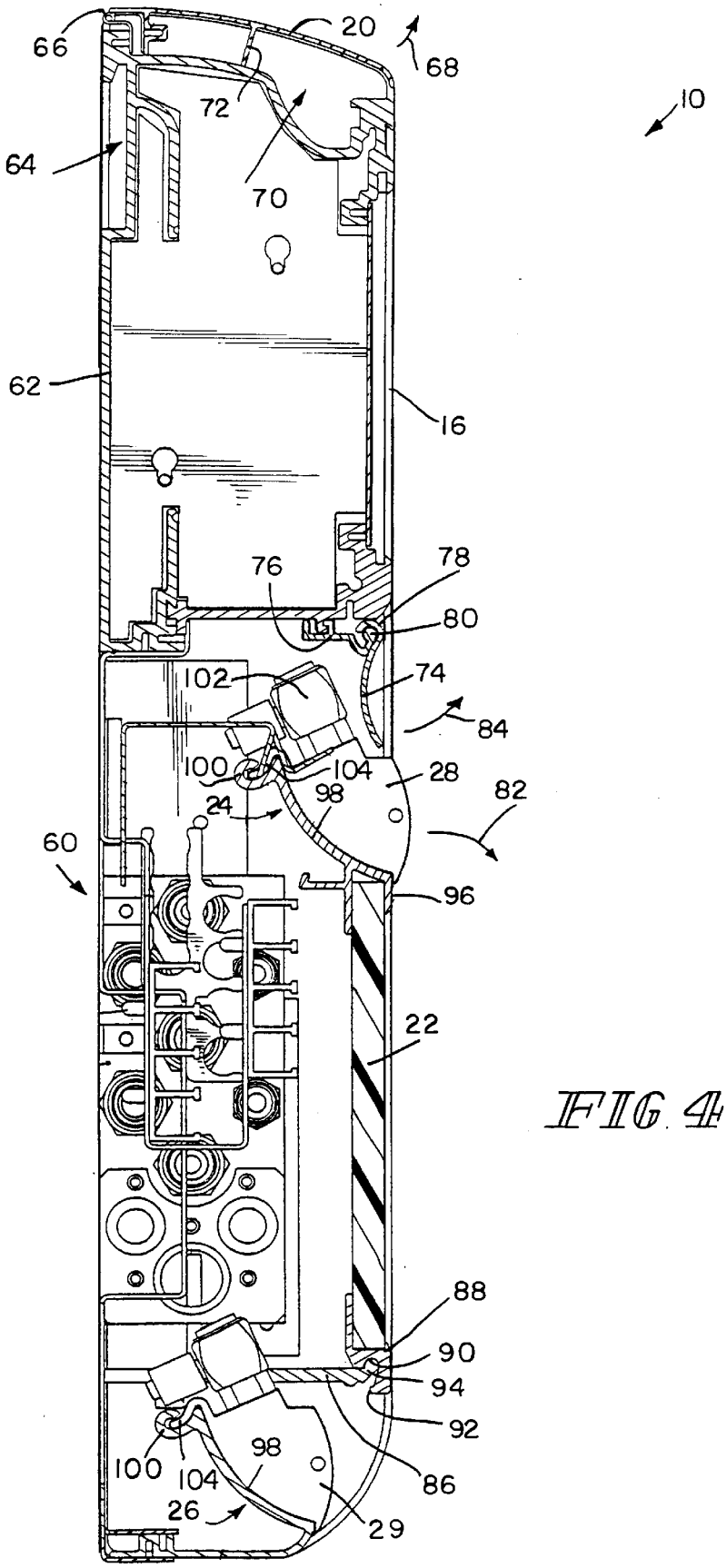
FIG. 4 is a sectional view taken through the head wall of FIGS. 1–3.

After the head wall 10 is installed as shown in FIG. 3, a bed locator 54 is installed below the head wall 10 on hanger strip 36. Hoses 31, 33 are then connected to the manifold block 40 as discussed below. End caps 14 are then installed on opposite ends of the head wall 10.

FIGS. 4–7 illustrate details of the head wall 10 and the hose management apparatus 60 of the present invention. Head wall 10 includes a rear support bracket 62 having a notched section 64 configured to be mounted over the top hanger 34. Concealment cover 20 is pivotably coupled to support 62 by hinge connection 66. Cover 20 is pivotable upwardly in the direction of arrow 68 to expose an upper raceway section 70. A stop 72 extends downwardly from cover 20.

A flip door 74 is coupled to a support 76. Door 74 is hinged to support 76 by a curved top end 78 which extends over edge 80 of support 76. When panel 22 is pivoted outwardly in the direction of arrow 82, the flip door 74 is pivoted upwardly in the direction of arrow 84.

Panel 22 is pivotably coupled to a lower support 86. Specifically, a bottom end portion 88 is coupled to panel 22. Bottom portion 88 includes a notched section 90 and a stop 92. The notched section 90 is configured to receive an end edge 94 of support 86. Panel 22 may therefore be pivoted outwardly in the direction of arrow 82 until stop 92 hits a notch formed in support 86.

Track 24 has a U-shaped channel 96 located over a top end of front hose panel 22. Tracks 24 and 26 include a curved body portion 98 and an upper track member 100. Track member 100 is formed to provide a curved slot. Illustratively, tracks 24 and 26 are formed from an extruded aluminum material.

Gas blocks 28 and 29 include an internal passageway. A swivel connection 102 is rotatably coupled to a rear surface of each gas block 28 and 29. Swivel connection 102 permits a gas supply hose 31, 33 to be coupled to an inlet end of gas block 28, 29. Each gas block 28, 29 is formed to include a curved rear flange or lip 104 having a generally S-shape. The curve of lip 104 matches the configuration of the slot of track member 100. Illustratively, gas blocks 28 and 29 are made from an extruded aluminum material.

In order to install the gas blocks 28, 29 onto the tracks 24, 26 the front hose panel 22 is pivoted outwardly. Gas blocks 28, 29 are aligned at an angle relative to tracks 24, 26 so that an end of lip 104 can enter the slot of track member 100. Once the gas blocks 28, 29 are installed, the front hose panel 22 is pivoted back to an upright position shown in FIGS. 4 and 5.

Figure 5:
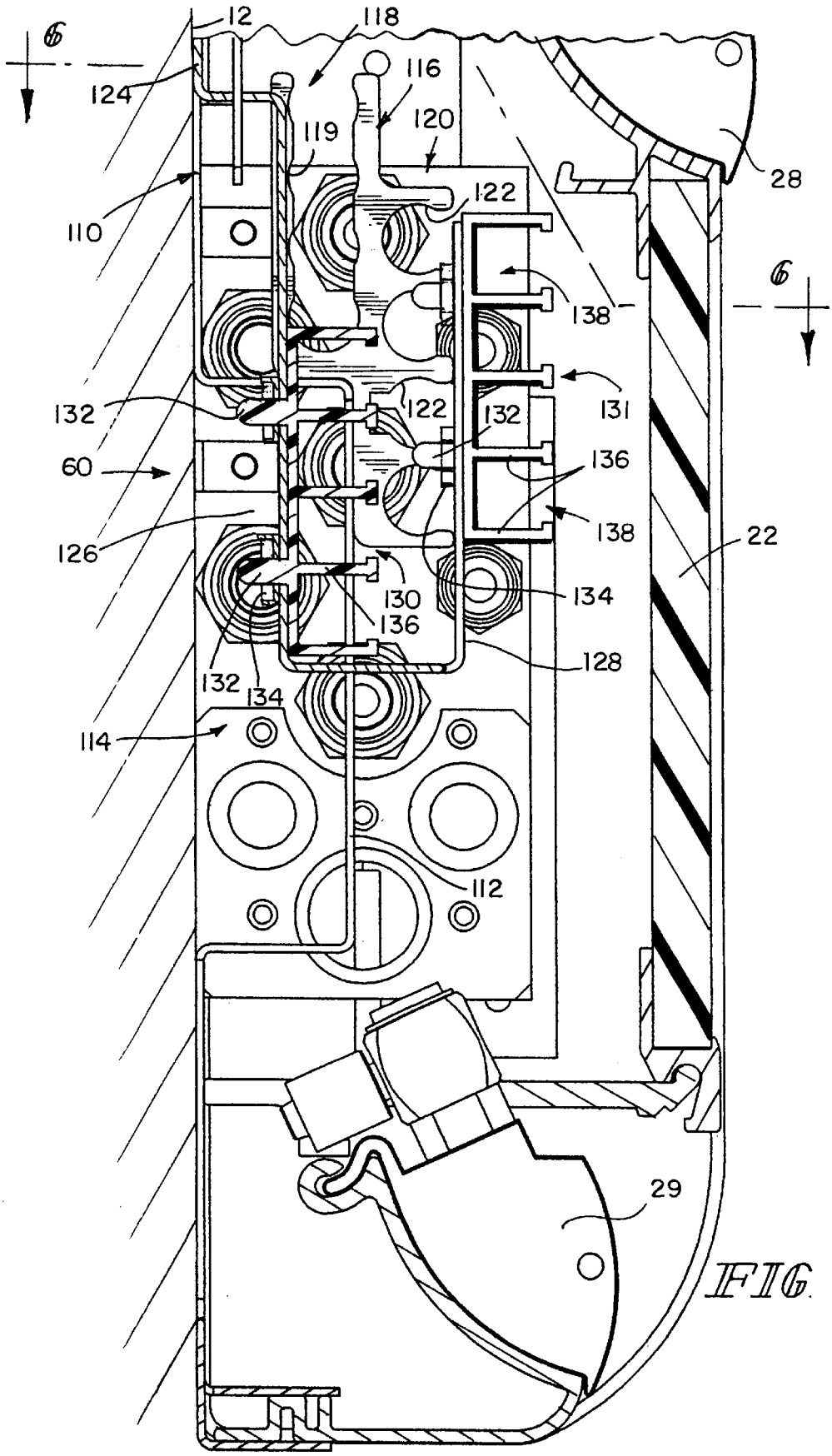
FIG. 5 is an enlarged view of a portion of the head wall of FIG. 4 illustrating a hose management system of the present invention.
Figure 6:
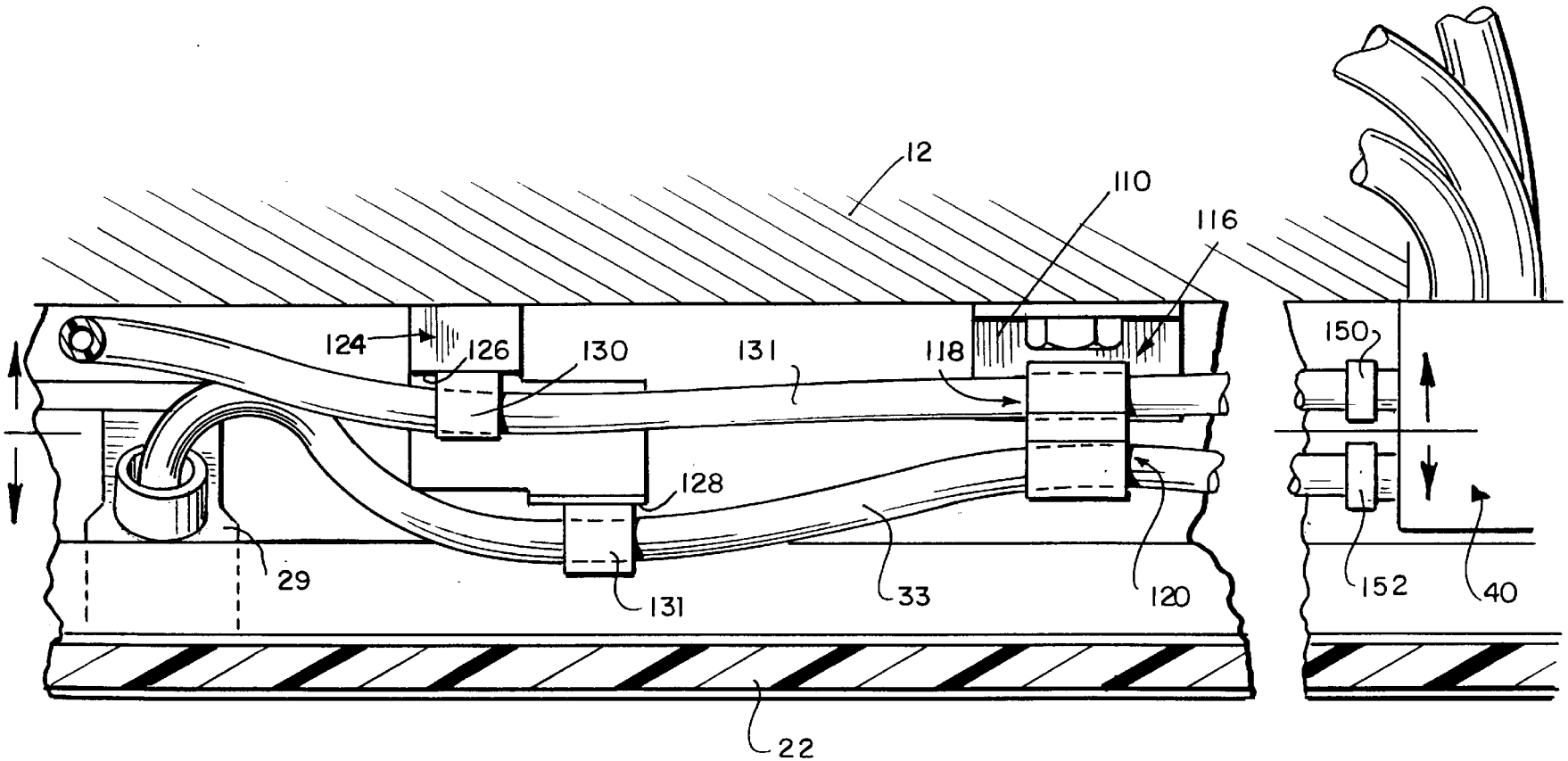
FIG. 6 is a sectional view taken along lines 6—6 of FIG. 5 further illustrating the hose management system of the present invention.
Figure 7:
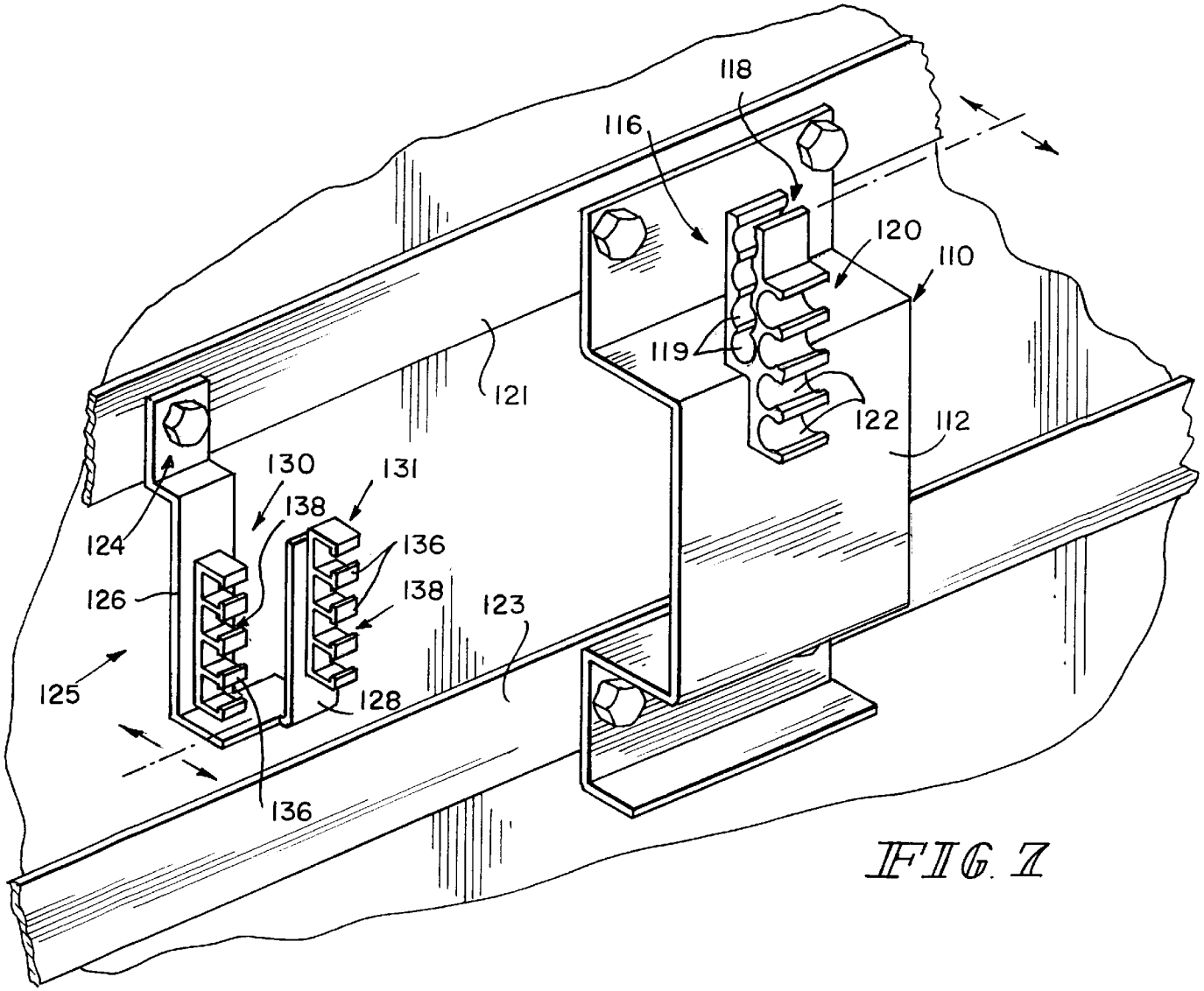
FIG. 7 is a perspective view of first and second brackets configured to separate gas supply hoses of the head wall into first and second spaced apart pathways to organize and manage movement of the hoses within the head wall.

The hose management system 60 of the present invention is best illustrated in FIGS. 5–7. A first mounting bracket or spreader bar 110 illustratively includes an outwardly projecting central portion 112 which defines an inner region 114 adjacent wall 12 for receiving gas lines 46 coupled to manifold 42. A first hose receiving bracket 116 is mounted on spreader bar 110 by a fastener (not shown) which extends through the bracket 116 and the spreader bar 110. Bracket 116 includes a first hose receiving portion 118 and a second hose receiving portion 120. As best shown in FIG. 7, the first hose receiving portion 118 of bracket 116 includes a plurality of separate hose engaging portions 119. The second hose receiving portion 120 includes a plurality of separate hose engaging portions 122. Hose contacting portions 119 and 122 are configured to hold a plurality of hoses 31 and 33, respectively, in vertically stacked orientations in both the first hose receiving portion 118 and the second hose receiving portion 120. Therefore, the hoses 31, 33 are held in separate, spaced apart planes by bracket 116.

As best shown in FIG. 6, gas supply hoses 31 for top gas blocks 28 (shown in FIGS. 1–5) are illustratively located within the first hose receiving portion 118 of bracket 116. Gas hoses 33 for the bottom gas outlet blocks 29 illustratively snap within separate hose receiving channels 122 of the second hose receiving portion 120. Therefore, the mounting bracket 116 provides two separate pathways including a rear pathway defined by the first portion 118 for receiving the first set of hoses 31 coupled to the gas blocks 28 on a top portion of the head wall 10 and a second front pathway, spaced outwardly from the first pathway for receiving a second set of hoses 33 coupled to gas outlet blocks 29 on a bottom portion of head wall 10.

The configuration of the spreader bar 110 is further illustrated in FIG. 7. The spreader bar 110 is coupled at opposite ends to supports 121 and 123 the head wall 10 and shipped with the head wall 10.

A second mounting bracket 124 includes a U-shaped section 125 having a downwardly extending arm 126 and an upwardly extending arm 128. Plastic clips 130 and 131 are coupled to the first and second arms 126 and 128. Attachment posts 132 of clips 130, 131 extend through apertures formed in arms 126 and 128. Illustratively, the posts 132 are threaded for receiving lock nuts 134 to couple the clips 130, 131 to the arms 126 and 128. Each mounting clip 130, 131 includes upwardly extending dividers 136 which define spaced apart hose receiving portions 138.

As shown in FIGS. 6 and 7, the mounting bracket 124 is spaced apart from spreader bar 110. Separate spreader bars 110 and mounting brackets 124 are located on each side of the head wall 10. Clips 130, 131 attached to bracket 124 also provide first and second pathways for the gas hoses 31, 33. The first pathway is defined by the clip 130 coupled to leg 126, and the second pathway is defined by clip 131 coupled to leg 128. Hoses 31 in rear pathway 118 of bracket 116 extend through the inner clip 130 coupled to leg 126, and hoses 33 from the front pathway 120 of bracket 116 extend through the outer clip 131 coupled to leg 128.

Inner and outer clips 130 and 131 are configured to hold the plurality of hoses 31 and 33, respectively, in vertically stacked orientations. Therefore, the hoses 31, 33 are held in separate, spaced apart pathways or planes by clips 130 and 131.

Since the mounting brackets 110 and 124 and clips 116, 130, and 131 are mounted to head wall 10 during shipment, the gas hoses 31, 33 within the head wall 10 are already properly aligned when they are received by the customer. Therefore, the brackets 110 and 124 and clips 116, 130, and 131, provide an apparatus for organizing and controlling separate pathways for the upper and lower gas block supply hoses 31, 33. Gas hoses 31, 33 coupled to gas blocks 28, 29 loop in a C-shaped configuration to facilitate sliding of the gas blocks and reduce the likelihood of binding of the hoses 31, 33.

Although brackets 110 and 124 and clips 116 and 130 are used to define the front and rear pathways for receiving the hoses 31, 33, it is understood that other types of dividers may be used in accordance with the present invention. For instance, different types of clips may be used to receive the hoses. In addition, a full sheet divider made of sheet metal or other material may be used to divide the interior region of the head wall 10 into two separate pathways for receiving first and second sets of gas hoses 31, 33 for the gas blocks 28 in the upper and lower regions of the head wall 10. The first and second pathways hold the hoses 31, 33 in a proper position during transport and facilitate installation of the head wall 10 on the wall 12.

After the head wall 10 is received at the hospital and installed on the wall 12, connectors 150 and 152 of hoses 31, 33, respectively, are connected to outlets of the manifold block 40 as best shown in FIG. 6. FIG. 6 also further illustrates the first and second pathways for the upper hoses 31 and lower hoses 33.

Although the invention has been described in detail with reference to a certain illustrated embodiment, variations and modifications exist within the scope and spirit of the invention as described and as defined in the following claims.

What is claimed is:

1. A head wall apparatus comprising:

a support configured to be coupled to a wall;

a front panel coupled to the support to define an interior region of the head wall;

a plurality of first gas blocks coupled to the support, each of the first gas blocks having an inlet and an outlet;

a plurality of second gas blocks coupled to the support spaced apart from the first gas blocks, each of the second gas blocks having an inlet and an outlet;

a plurality of first gas supply hoses located in the interior region, each of the first gas supply hoses having a first end coupled to the inlet of one of the first gas blocks and a second end configured to be coupled to a gas supply on the wall;

a plurality of second gas supply hoses located in the interior region, each of the second gas supply hoses having a first end coupled to the inlet of one of the second gas blocks and a second end configured to be coupled to a gas supply on the wall; and at least one divider coupled to the support within the interior region, the at least one divider being configured to separate the first and second gas supply hoses into first and second separate pathways within the interior region.

2. The apparatus of claim 1, wherein the at least one divider includes a bracket coupled to the support, the bracket including first and second receptacles configured to receive the first and second gas supply hoses, respectively.

3. The apparatus of claim 2, wherein the first receptacle of the bracket is formed to include a plurality of hose engaging portions configured to align the plurality of first hoses in a vertically stacked orientation and the second receptacle includes a plurality of hose engaging portions configured to align the plurality of second hoses in a vertically stacked orientation spaced apart from the first hoses to define the first and second separate pathways.

4. The apparatus of claim 3, wherein the first receptacle is formed to include an upwardly extending opening configured to receive the plurality of first gas supply hoses.

5. The apparatus of claim 3, wherein the second receptacle includes a plurality of spaced apart channels, each channel being configured to receive one of the second gas supply hoses.

6. The apparatus of claim 2, wherein the at least one divider further includes a second bracket coupled to the support spaced apart from the first bracket, the second bracket including a third receptacle configured to receive the plurality of first gas supply hoses and a fourth receptacle configured to receive the plurality of second gas supply hoses, the third and fourth receptacles being spaced apart to define further portions of the first and second pathways within the interior region.

7. The apparatus of claim 6, wherein the second bracket includes a U-shaped portion having a first extending arm and a second extending arm and a third arm extending therebetween, the third receptacle being coupled to the first arm and the fourth receptacle being coupled to the second arm.

8. The apparatus of claim 6, wherein the third and fourth receptacles each include a clip formed to include a plurality of hose receiving channels.

9. The apparatus of claim 8, wherein the plurality of channels of the clips of the third and fourth receptacles are aligned in spaced apart vertical planes.

10. The apparatus of claim 8, further comprising at least two fasteners for securing the clips to the second bracket.

11. The apparatus of claim 1, further comprising first and second spaced apart tracks configured to support the first and second gas blocks, respectively, for movement relative to the front panel.

12. The apparatus of claim 11, wherein the first track and first gas blocks are located along an upper portion of the head wall and the second track and the second gas blocks are located along a lower portion of the head wall.

13. The apparatus of claim 11, wherein the first and second tracks are formed by first and second upwardly extending walls.

14. The apparatus of claim 13, wherein the first and second gas blocks are each formed to include a groove configured to receive a top end of the first and second upwardly extending walls, respectively.

15. A head wall apparatus comprising:

a support configured to be coupled to a wall;

a front panel coupled to the support to define an interior region of the head wall;

a plurality of first gas blocks coupled to the support, each of the first gas blocks having an inlet and an outlet;

a plurality of second gas blocks coupled to the support spaced apart from the first gas blocks, each of the second gas blocks having an inlet and an outlet;

a plurality of first gas supply hoses located in the interior region, each of the first gas supply hoses having a first end coupled to the inlet of one of the first gas blocks and a second end configured to be coupled to a gas supply on the wall;

a plurality of second gas supply hoses located in the interior region, each of the second gas supply hoses having a first end coupled to the inlet of one of the second gas blocks and a second end configured to be coupled to a gas supply on the wall; and means for dividing the interior region into first and second separate pathways for receiving the first and second gas supply hoses, respectively.

16. The apparatus of claim 15, wherein the dividing means includes a first bracket coupled to the support, the first bracket including first and second receptacles configured to receive the first and second gas supply hoses, respectively, and the dividing means also including a second bracket coupled to the support spaced apart from the first bracket, the second bracket including a third receptacle configured to receive the plurality of first gas supply hoses and a fourth receptacle configured to receive the plurality of second gas supply hoses, the third and fourth receptacles being spaced apart to define further portions of the first and second pathways.

17. The apparatus of claim 16, wherein the first, second, third and fourth receptacles are configured to align the plurality of first and second gas supply hoses in vertically stacked orientations to define the first and second separate pathways.

18. The apparatus of claim 15, further comprising first and second spaced apart tracks configured to support the first and second gas blocks, respectively, for movement relative to the front panel.

19. The apparatus of claim 18, wherein the first track and first gas blocks are located along an upper portion of the head wall and the second track and the second gas blocks are located along a lower portion of the head wall.

* * * * *